US007900322B2

(12) United States Patent
Doring et al.

(10) Patent No.: US 7,900,322 B2
(45) Date of Patent: Mar. 8, 2011

(54) FRICTION HINGE FOR PUSH-OUT STYLE WINDOW

(75) Inventors: Craig M. Doring, Owatonna, MN (US); Thomas Soukup, Owatonna, MN (US); James Seaser, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 107 days.

(21) Appl. No.: 11/961,861

(22) Filed: Dec. 20, 2007

(65) Prior Publication Data

US 2008/0155783 A1 Jul. 3, 2008

Related U.S. Application Data

(60) Provisional application No. 60/876,069, filed on Dec. 20, 2006, provisional application No. 60/986,871, filed on Nov. 9, 2007.

(51) Int. Cl.
*E05D 15/00* (2006.01)

(52) U.S. Cl. ..... 16/362; 16/368; 16/369; 16/370; 49/246; 49/250; 49/398

(58) Field of Classification Search ..... 16/235, 16/273, 240, 366, 371, 362–364, 368, 357, 16/242; 49/381, 382, 386, 400, 397, 385, 49/404, 247, 260, 261, 345, 398; 33/452, 33/456, 460, 464
See application file for complete search history.

(56) References Cited

U.S. PATENT DOCUMENTS 4,674,149 A * 6/1987 Vetter ..... 16/341
4,833,754 A * 5/1989 Yang ..... 16/339
5,794,310 A * 8/1998 Dallmann ..... 16/362
6,000,071 A * 12/1999 Fettes ..... 4/498
6,041,548 A * 3/2000 Miller ..... 49/345
6,434,887 B2 * 8/2002 Nakanishi et al. ..... 49/246
6,513,194 B2 * 2/2003 Harkins et al. ..... 16/239
6,643,896 B2 * 11/2003 Carrier ..... 16/242
2004/0055113 A1 3/2004 Tremblay et al.

(Continued)

FOREIGN PATENT DOCUMENTS

GB 2295645 A * 6/1996

(Continued)

OTHER PUBLICATIONS

Website printout dated Dec. 14, 2006, Entitled: Security House Manufacturers for all your aluminum window and se . . . Casement windows, located at www.shm.com.au/casement.asp. 1 Pg.
Website printout dated Dec. 14, 2006, Entitled: Loewen Push Out Casement Windows//Hardware, located at www.Loewen.com/hom.nsf/windows/pushoutcasement/hardware. 2 Pgs.

(Continued)

*Primary Examiner* — Thomas B Will
*Assistant Examiner* — Emily M Morgan
(74) *Attorney, Agent, or Firm* — Patterson Thuente Christensen Pedersen, P.A.

(57) ABSTRACT

A push-out style window assembly including window hardware for frictionally retaining an open position of the window under typical loading conditions. A push-out style window assembly generally includes a friction hinge assembly including a track, a sash arm, a support arm, and a friction arm. The friction arm can include an adjustable and/or detachable slide enabling adjustment of a frictional resistance between the friction slider and the support arm. Using the friction arm, frictional resistance is provided so as to provide control both during opening of the window and in retaining the position of an open window.

14 Claims, 7 Drawing Sheets

U.S. PATENT DOCUMENTS

2005/0055804 A1 3/2005 Liang et al.
2005/0223524 A1 * 10/2005 Muir ..... 16/366

FOREIGN PATENT DOCUMENTS

WO WO 9502106 A1 * 1/1995

OTHER PUBLICATIONS

Website printout dated Dec. 14, 2006, Entitled: Kolbe Windows and Doors, 4 Pgs., © 2006 Kolbe, located at www.kolbe-kolbe.com.

* cited by examiner

Fig. 1
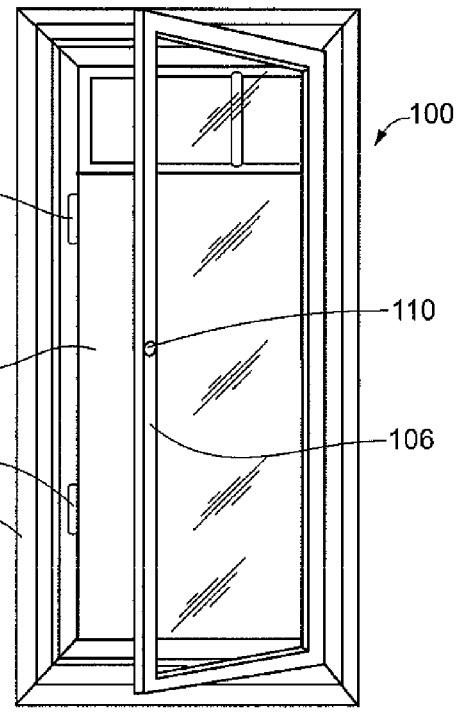
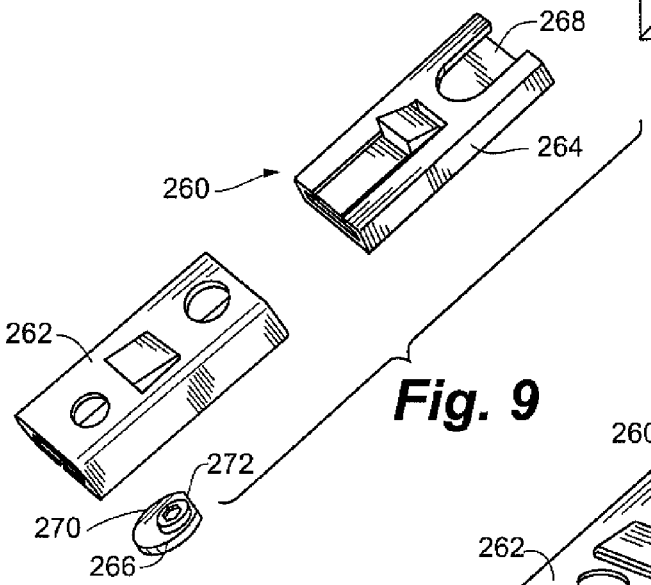
Fig. 9
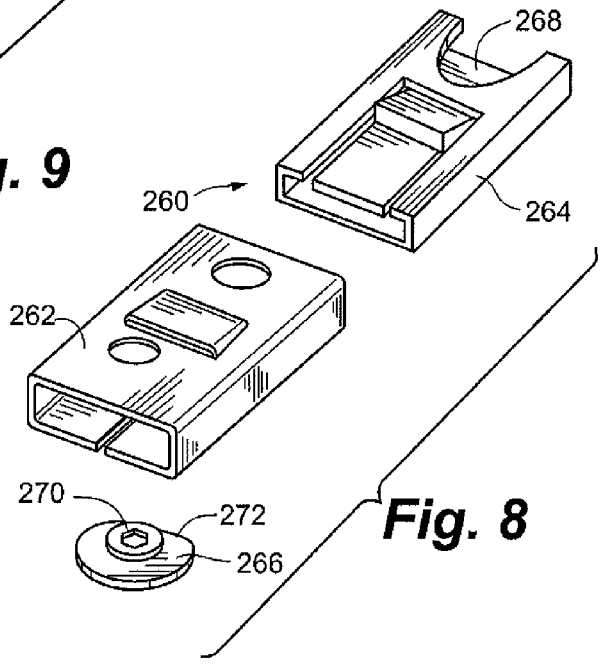
Fig. 8

FRICTION HINGE FOR PUSH-OUT STYLE WINDOW

RELATED APPLICATIONS

This application claims the benefit of U.S. Provisional Patent Application Nos. 60/876,069, filed Dec. 20, 2006, and 60/988,871 filed Nov. 9, 2007, both of which are hereby incorporated herein by reference.

FIELD OF THE INVENTION

The present invention relates generally to push-out style windows. More particularly, embodiments of the present invention relate to hinges for frictionally securing a push-out style window in an open position.

BACKGROUND OF THE INVENTION

Push-out style windows have been installed with increasing frequency due in part to their style and increased viewability therethrough. These windows are available in, for example, casement and awning types. Generally, push-out style windows include an outer window and a hingedly mounted screen that is inwardly rotatable. By rotating the hinged screen inwardly, access is provided to the outer window from the inside. The outer window is generally also hingedly mounted so as to be outwardly rotatable.

When an operator desires to open the window, the operator can unlatch the window and push on the window to a desired open position. The force used to open the window is applied directly to the window, such as on the sash, as compared to using a rotatable or lever-actuated assembly to open the window.

While push-out style windows have provided an easy and elegant window system, they can suffer problems related to maintaining the desired open position under loading conditions such as, for example, on a windy day. As such, there is a need for improved push-out style windows.

SUMMARY OF THE INVENTION

A push-out style window assembly of embodiments of the present disclosure addresses the above-mentioned needs and includes window hardware capable of frictionally retaining an open position of the window under many loading conditions including, for example, those created by wind.

Generally, a push-out style window assembly includes a friction hinge assembly operably attached between a window frame and a window sash. The friction hinge assembly generally includes a track, a sash arm, a support arm, and a friction arm.

On one end, the friction arm may be mounted to the track with a connector. On the opposed end, the friction arm may include a friction slider for slidably connecting the friction arm with the support arm such that the position of the friction arm can be variably positioned depending upon the desired position of the window. The friction arm can include an adjustable slide, enabling adjustment of a frictional resistance between the friction slider and the support arm. Using the friction arm, additional frictional resistance is provided so as to retain a window in a desired position when exposed to external forces such as, for example, wind.

In one aspect, the present disclosure relates to a friction hinge assembly for a push-out style window. An embodiment of the friction hinge assembly generally includes a track, a sash arm, a support arm, and a friction arm. On one end, the friction arm can be retainably mounted to the track with a suitable connector while on the opposed end, the friction arm can include a friction slider assembly for slidably connecting the friction arm with the support arm such that the position of the friction arm can be variably positioned along the support arm with the position being dependent upon the position of the window.

The friction slider assembly can include a slider, a collar, and a friction adjustment member. The friction adjustment member generally includes a suitable adjusting mechanism such as, for example, a set screw or cam arrangement for variably adjusting the frictional engagement of the slider and the friction arm. The friction adjustment member can operate against the slider in either a vertical or horizontal axis. With the friction arm, additional frictional resistance is provided so as to retain a push-out style window in a desired position when exposed to external forces such as, for example, wind. In addition, the friction adjustment member enables the frictional resistance provided by the friction hinge assembly to be manually adjusted by a user.

In another aspect, a method for retaining a push-out style window in a desired open position generally includes supplying a friction hinge assembly having a friction arm slidably mounted between a track and a support arm. An embodiment of a method may further include adjusting a frictional resistance provided by the friction hinge assembly by manually adjusting a friction adjustment member on a friction slider assembly that slidably connects the friction arm with the support arm.

In yet another aspect, the present disclosure relates to a push-out style window system for frictionally retaining a push-out window in a desired open position. Generally, the push-out style window system includes a window frame, an inwardly rotatable window screen, a friction hinge assembly, and a push-out style window. The friction hinge assembly is operably attached between the window frame and the push-out style window. The friction hinge assembly generally includes a track mounted to the window frame, a sash arm connecting the track and the push-out style window, a support arm mounted between the track and the sash arm, and a friction arm slidably mounted between the track and the support arm. On one end, the friction arm can be anchored to the track with a suitable connector. On the opposed end, the friction arm can include a friction slider for slidably connecting the friction arm with the support arm such that the position of the friction arm can be variably positioned depending upon the desired position of the push-out style window. The friction arm can include an adjustable slide enabling adjustment of a frictional resistance between the friction slider and the support arm. Using the friction arm, additional frictional resistance is provided so as to retain the push-out style window in a desired position when exposed to external pressure and to provide desired resistance when opening the push-out style window to a desired position.

In another aspect, the present disclosure relates to an adjustable slider assembly for selectively controlling the friction resistance of a push-out style window. The adjustable slider assembly may include a manually engageable cam for selectively varying the level of friction engagement between a slider assembly and a support arm.

In yet another aspect, a slider assembly can include a friction slider having an opening, seam, or other mechanical or non-mechanical mechanism enabling selective detaching of the slider assembly from a support arm. Such an assembly may enable ease of cleaning or replacement of components of a slider assembly, including a friction slider as part of a slider assembly.

In a further aspect, a friction slider assembly can include an offset formed on a friction slider or sleeve, which can provide creep relief for a friction slider or sleeve when the hinge is closed, which is the state in which hinge is in for a majority of the life cycle of the window. The offset can correspond to an angled offset included on support arm enabling the opening and closing of the hinge. The inclusion of the offset on the sleeve can enable the life of friction slider assembly and thus the window assembly to be lengthened.

Accordingly, embodiments of the present invention may include a window assembly with a frame defining an opening, a sash assembly receivable in the opening of the frame, and at least one friction hinge operably coupling the sash assembly to the frame such that the sash assembly is selectively shiftable between a closed position in which the sash assembly is received in the frame to close the opening and an open position in which the sash assembly is disposed at an angle relative to the frame. The friction hinge includes a track on the frame, a slider slidable along the track, and a sash arm on the sash. The sash arm is pivotally coupled to the slider, and the friction hinge further includes a support arm pivotally coupled to the track and pivotally coupled to the sash arm, and a friction arm assembly including a friction arm pivotally coupled to the sash arm and a friction slider assembly pivotally coupled to the friction arm and slidable along the support arm. The friction slider assembly frictionally engages the support arm to provide a biasing force resisting shifting of the sash assembly between the open position and the closed position.

In further embodiments, the friction slider assembly includes a slider frictionally engaged with the support arm and a friction adjustment mechanism for enabling selective adjustment of a magnitude of friction between the slider and the support arm. The friction adjustment mechanism may include a set screw or an adjustable cam. The slider may be coated with a polymeric material such as acetal.

In further embodiments, the friction slider assembly may be selectively detachable from the friction arm and the support arm. The support arm may have an offset portion disposed so that the friction slider assembly is engaged with the offset portion when the sash assembly is in the closed position.

In an embodiment, a window assembly includes a frame defining an opening, a sash assembly receivable in the opening of the frame, and at least one friction hinge operably coupling the sash assembly to the frame such that the sash assembly is selectively shiftable between a closed position in which the sash assembly is received in the frame to close the opening and an open position in which the sash assembly is disposed at an angle relative to the frame. The friction hinge includes a track on the frame, a slider slidable along the track, and a sash arm on the sash. The sash arm is pivotally coupled to the slider, and the friction hinge further includes a support arm pivotally coupled to the track and pivotally coupled to the sash arm, and means for providing a biasing force resisting shifting of the sash assembly between the open position and the closed position. The means for providing a biasing force resisting shifting of the sash assembly between the open position and the closed position may include a friction arm assembly including a friction arm pivotally coupled to the sash arm and a friction slider assembly pivotally coupled to the friction arm and slidable along the support arm, wherein the friction slider assembly frictionally engages the support arm to provide the biasing force resisting shifting of the sash assembly between the open position and the closed position.

In an embodiment, the friction slider assembly includes means for selectively adjusting a magnitude of friction between the slider and the support arm, which may include a set screw or an adjustable cam. The friction slider assembly may be selectively detachable from the friction arm and the support arm.

The above summary of various embodiments of the invention is not intended to describe each illustrated embodiment or every implementation of the invention. Rather, the embodiments are chosen and described so that others skilled in the art may appreciate and understand the principles and practices of the invention. The figures in the detailed description that follows more particularly exemplify these embodiments.

BRIEF DESCRIPTION OF THE FIGURES

The invention may be more completely understood in consideration of the following detailed description of various embodiments of the invention in connection with the following drawings, in which:

FIG. 1 is a perspective view of a push-out style casement window taken from an inside location of a structure;

FIG. 8 is an exploded, top perspective view of a second embodiment of an adjustable friction slider assembly of the present disclosure;

FIG. 9 is an exploded, top perspective view of the adjustable friction slider assembly of FIG. 8.

Figure 2:
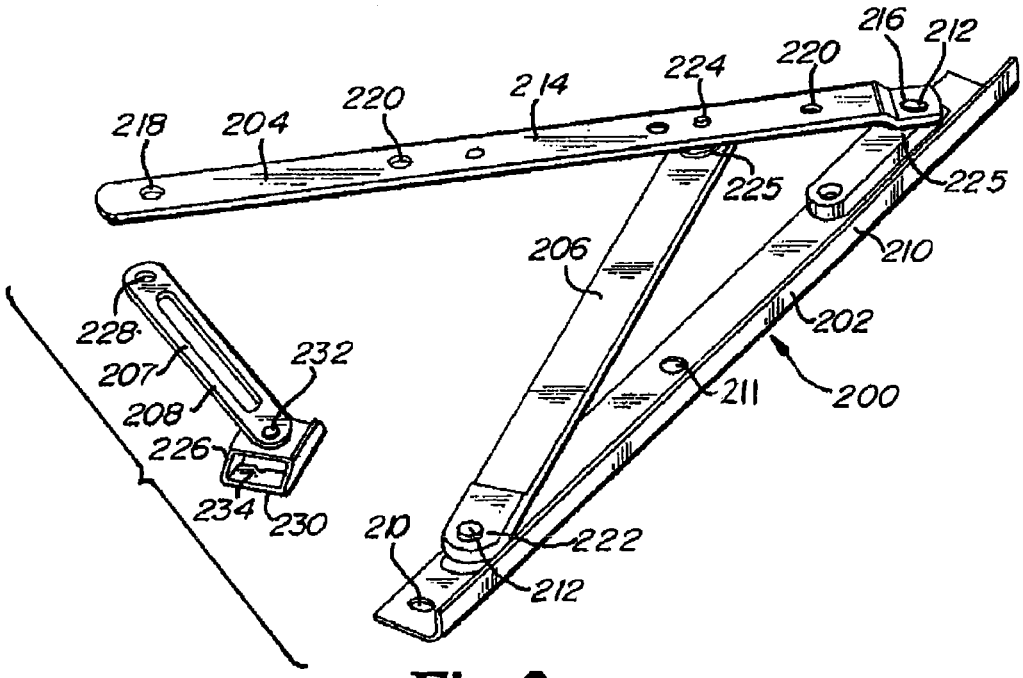
FIG. 2 is a top, perspective view of a first embodiment of a partially disassembled friction hinge assembly.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE INVENTION

A push-out style window assembly 100 is shown generally in FIG. 1. Push style window assembly 100 generally includes a window frame 102, a sash 104, and an inwardly rotatable screen 106. Window frame 102 generally includes one or more latching members 108 for operably locking the sash 104 in a closed disposition. Inwardly rotatable screen 106 generally includes a handle 110 enabling a user to pull the inwardly rotatable screen 106 into a structure when it is desired to open the sash 104. As depicted in FIG. 1, push-out style window assembly 100 is a casement window, though the friction hinge assembly of embodiments of the present invention can be utilized with a variety of push-out style window designs, for example awning style windows.

Figure 3:
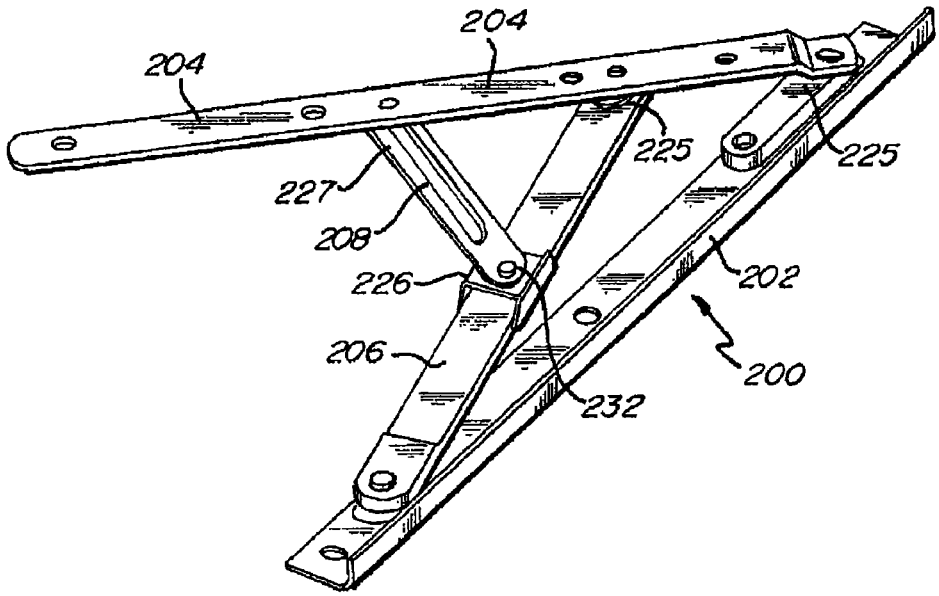
FIG. 3 is a top, perspective view of the assembled friction hinge assembly of FIG. 2.
Figure 4:
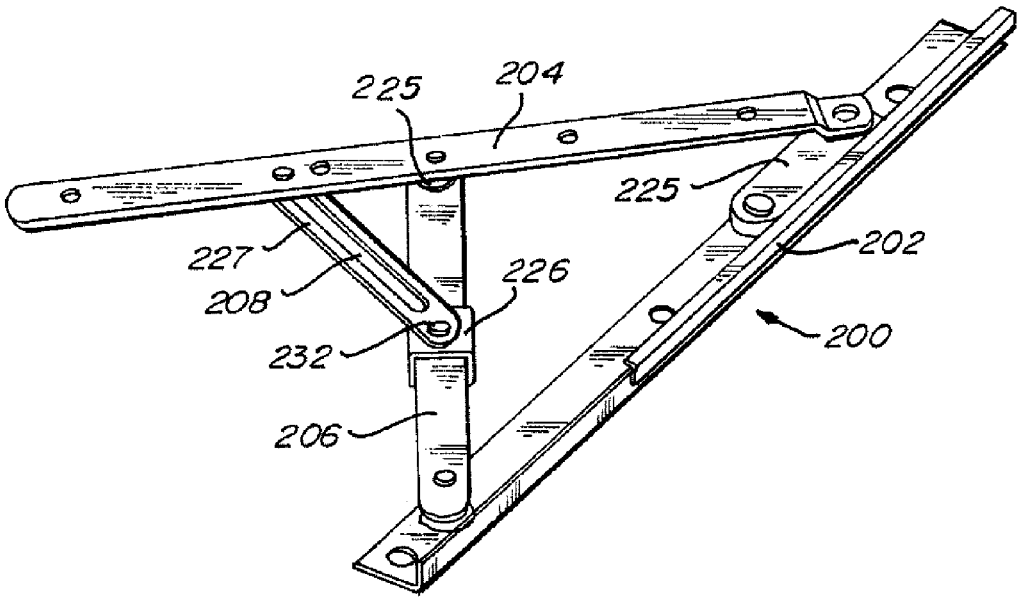
FIG. 4 is a top, perspective view of the assembled friction hinge assembly of FIG. 2.

Referring to FIGS. 2, 3 and 4, an embodiment of a friction hinge assembly 200 generally includes a track 202, a sash arm 204, a support arm 206, and a slidable friction arm assembly 208. Track 202 generally includes a track body 210, a plurality of track mounting apertures 211, and a plurality of track connecting members 212. Track connecting members 212 generally includes apertures for receiving connectors such as, rivets or disassemblable fasteners or alternatively, track connecting members 212 generally includes projecting members integral to the track body 210. Sash arm 204 generally includes a sash arm body 214, a sash track aperture 216, a sash window aperture 218, and a plurality of adjustment apertures 220. Support arm 206 generally includes a support track aperture 222 and a support sash aperture 224. Slidable friction arm assembly 208 generally includes an adjustable slider assembly 226 and a friction arm 227 having a friction sash aperture 228. Adjustable slider assembly 226 generally includes a friction slider 230 and a set screw 232. Friction slider 230 generally includes a slider channel 234 sized for placement over and/or around the support arm 206. Friction hinge assembly 200 can be constructed of rigid materials having suitable corrosion resistance and wear properties such as, for example, 300 series stainless steel.

In use, friction hinge assembly mounts between the window frame 102 and a sash 104 such that the rotatable opening of sash 104 can be frictionally controlled and maintained. Track 202 is mounted to the window frame 102 and sash arm 204 is attached to the sash 104 using sash window aperture 218. Sash arm 204 can then be operably connected to track 202 using sash track aperture 216, a track aperture 211, and a connector 212. Slider channel 234 is slidably positioned over the support arm 206. Support track aperture 222 can then be utilized to connect the support arm 206 with the track 202 and support sash aperture 224 is utilized to connect the support arm 206 with the sash arm 204. Finally, friction sash aperture 228 is used to attach the friction arm 227 with the sash arm 204.

When a user desires to open the sash 104, the user first grasps the handle 110 and pulls the inwardly rotatable screen 106 into the interior of the structure. Next, the user unlocks the sash 104 by opening the one or more latching members 108. Finally, the user pushes the sash 104 to the desired position wherein the opening force provide by the user causes the sash arm 204 to rotate about the sash track aperture 216. This consequently causes the angular position of the support arm 206 to change relative to the track 202. As the sash arm 204 and support arm 206 move in response to the opening of sash 104, adjustable slider assembly 226 slides along the support arm 206. The friction between the friction slider 230 and the support arm 206 acts as a force buffer that requires a certain force to be overcome for the sash 104 to move to an open position. This force buffer inhibits the sash 104 from opening too rapidly as well as inhibiting an exterior force such as wind from closing the sash 104. The frictional resistance between the friction slider 230 can be adjusted by varying selectively tightening or loosening the set screw 232 or by using materials having higher or lower friction characteristics in friction slider 230 and/or the support arm 206. In addition, the force required to close an open window 204 can be manipulated through the inclusion of a polymeric washer or spacer 225 at one or both of the support sash aperture 224 and the sash track aperture 216. Inclusion of spacer 225 can increase the force necessary to overcome the rotational friction at the connection between the support arm 206 and the sash arm 204 and/or the track 202 and sash arm 204. Spacer 225 can be fabricated of suitable weather resistant polymers such as, for example, an acetal spacer. In addition, fiction slider 230 can be coated or fabricated of suitable polymeric materials such as, for example, acetal polymers so as to further increase the amount of frictional resistance provided by the slidable friction arm assembly 208.

Figure 5:
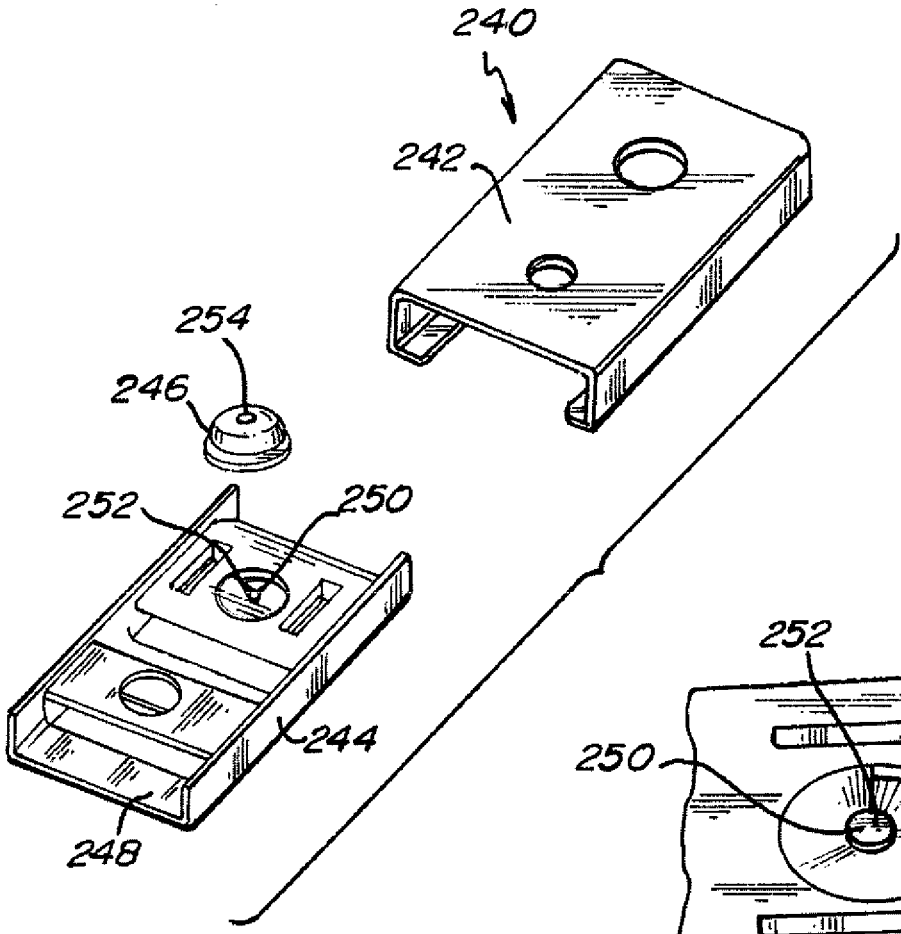
FIG. 5 is an exploded, top perspective view of a first embodiment of an adjustable friction slider assembly.
Figure 6:
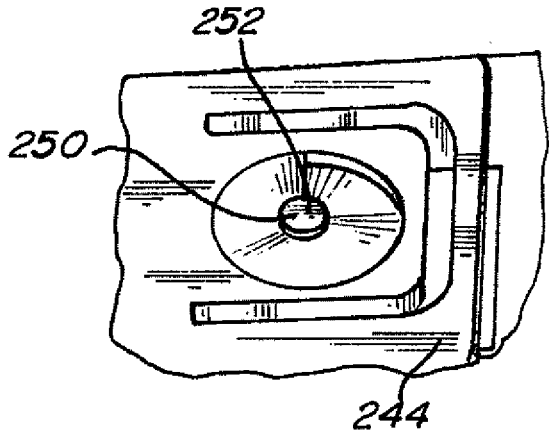
FIG. 6 is a detailed top perspective view of a friction slider used with the adjustable friction slider assembly of FIG. 5.
Figure 7:
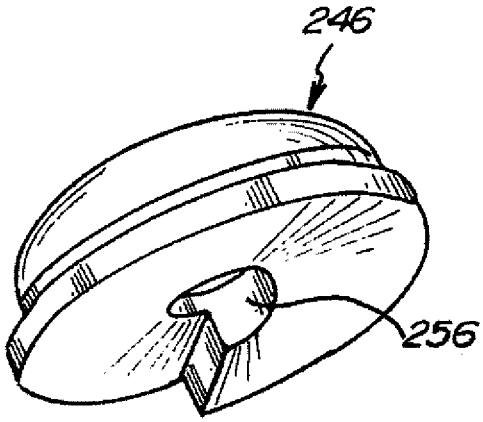
FIG. 7 is a bottom perspective view of a manually adjustable cam member used with the adjustable friction slider assembly of FIG. 5.

An alternative embodiment of a friction slider assembly 240 for use with friction hinge assembly 200 is illustrated in FIGS. 5, 6, and 7. Generally, friction slider assembly 240 generally includes a friction slider collar 242, a friction slider 244, and an adjustable cam 246. The friction slider 244 includes a slider channel 248 dimensioned to accommodate the support arm 206 as well as a slider ramp 250 having a threaded projection member 252. The adjustable cam 246 includes an input aperture 254 and a threaded bore 256.

In use, the threaded bore 256 enables the adjustable cam 246 to be threaded onto the threaded projection member 250. The friction slide collar 242 and the friction slider 244 can then be slidably positioned over the support arm 206. The friction slide collar 242 is then positioned over the friction slider 244 to capture the support arm 206 within the friction slider assembly 240. A user can then manually turn the adjustable cam 246 using the input aperture 254 and an appropriate tool to as to raise or lower the adjustable cam 246 on the threaded projection member 252. As the adjustable cam 246 is raised or lowered, the slider ramp 250 is selectively biased against the support arm 206 so as to adjust the frictional engagement of the friction slider assembly 240 and the support arm 206. In addition, friction slider assembly 240 can be coated or otherwise fabricated of suitable polymeric materials such as, for example, acetal polymers so as to further increase the amount of frictional resistance provided.

Another embodiment of a friction slider assembly 260 for use with friction hinge assembly 200 is illustrated in FIGS. 8 and 9. Generally, friction slider assembly 260 generally includes a friction slider collar 262, a friction slider 264, and an adjustable cam 266. The friction slider 264 includes a slider channel 268 dimensioned to accommodate the support arm 206. The adjustable cam 266 includes an input aperture 270 and a variable adjustment surface 272. The variable adjustment surface 272 defines a non-constant radius around a center axis of the adjustable cam 266.

In use, the adjustable cam 266 is positioned such that the input aperture 270 extends through a cam aperture 274 in the friction slider collar 262. The friction slide collar 262 and the friction slider 264 can then be slidably positioned over the support arm 206. The friction slide collar 262 is then positioned over the friction slider 264 to capture the support arm 206 within the friction slider assembly 260. A user can then manually turn the adjustable cam 266 using the input aperture 270 and an appropriate tool to as to spin the variable adjustment surface 272. Due to the non-constant radius of variable adjustment surface 272, the variable adjustment surface 272 can be selectively rotated to push the friction slider 264 against the support arm 206 so as to vary the frictional resistance between the friction slider assembly 260 and the support arm 206. In addition, friction slider assembly 260 can be coated or otherwise fabricated of suitable polymeric materials such as, for example, acetal polymers so as to further increase the amount of frictional resistance provided.

Figure 10:
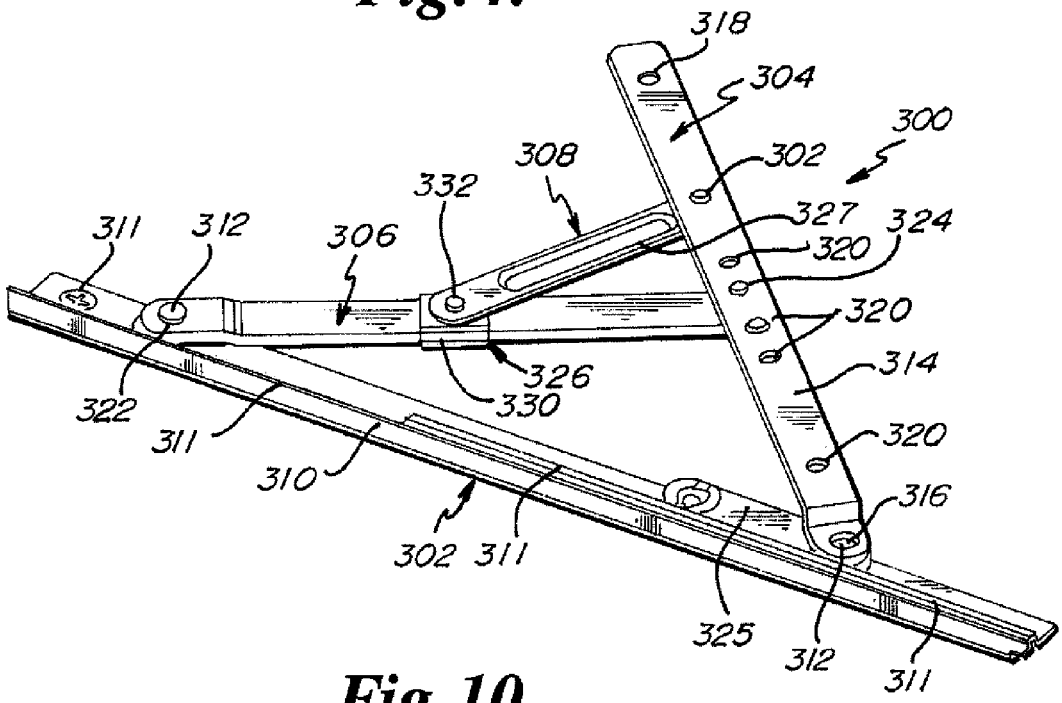
FIG. 10 is a top perspective view of an embodiment of a friction hinge assembly including a friction slider selectively detachable from a support arm, wherein the friction slider is depicted in an attached configuration.
Figure 11:
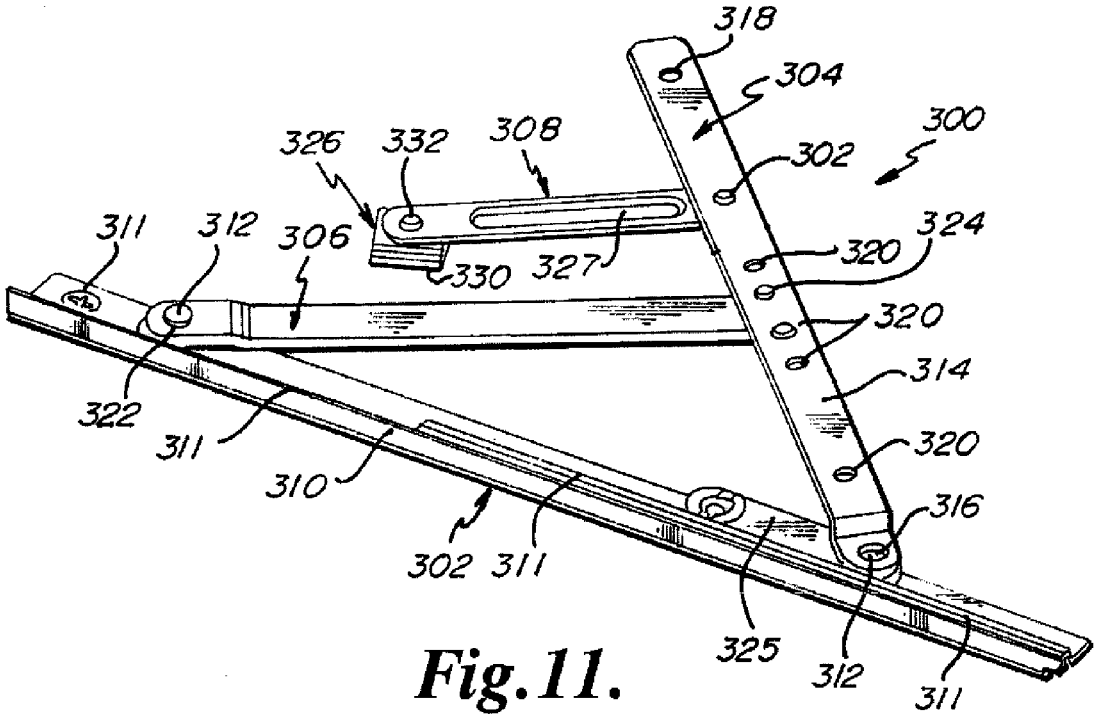
FIG. 11 is a top perspective view of the friction hinge assembly of FIG. 10, wherein the friction slider is depicted in a detached configuration.

A further embodiment of a friction slider assembly 300 including a detachable slider assembly 326 including a detachable friction slider or clip 330 is illustrated in FIGS. 10-12. Friction slider assembly 300 of this embodiment can enable ease of cleaning or replacement of detachable slider assembly 326 components, including friction slider 330.

Referring specifically to FIGS. 10 and 11, a friction hinge assembly 300 of this embodiment generally includes a track 302, a sash arm 304, a support arm 306, and a slidable friction arm assembly 308.

Track 302 generally comprises a track body 310, a plurality of track mounting apertures 311 presented therewith, and a plurality of track connecting members 312. Track connecting members 312 generally includes apertures for receiving connectors, such as rivets, screws, or disassembleable fasteners (e.g., threaded bolt). Alternatively, track connecting members 312 generally includes projecting members (as depicted) integral or otherwise operably coupled with track body 310. Sash arm 304 generally comprises a sash arm body 314, a sash track aperture 316 for operably coupling with track connecting members 312, a sash window aperture 318 for operably coupling with a window, and a plurality of adjustment apertures 320 presented therewith for selectively altering or adjusting the mechanics of the hinge. Support arm 306 generally includes a support track aperture 322 and a connecting member for operably coupling support arm 306 with sash arm 304.

Continuing to refer to FIGS. 10 and 11, slidable friction arm assembly 308 generally includes a detachable slider assembly 326 and a friction arm or drive link 327. Detachable slider assembly 326 generally includes a friction slider 330 and a set screw 332. Friction slider 330 can be made of a spring material, such as various stainless steel spring materials, and can be coated with a polymer coating. Detachable slider assembly 326 can be operably attached to friction arm 327 with, for example, a permanent fastener (e.g., rivet), a screw, a removable fastener (e.g., threaded bolt), or a projection or post. The force required to close an open window can be manipulated through the inclusion of a polymeric washer or spacer 325 at one or both of the support sash aperture 324 and the sash track aperture 316. Also, as discussed above, the mechanics of the hinge can be altered or adjusting using adjustment apertures 320.

Figure 12B:
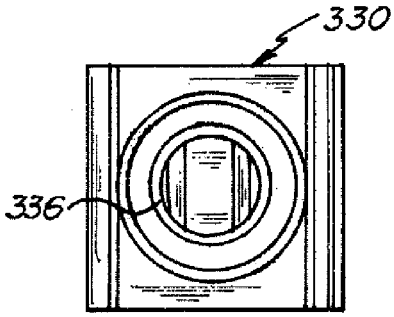
FIG. 12*b* is a close-up top plan view of the friction slider of FIG. 12*a;*
Figure 12A:
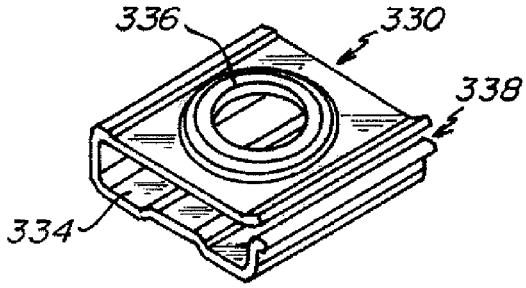
FIG. 12*a* is a close-up top perspective view of the friction slider of FIG. 10.
Figure 12C:
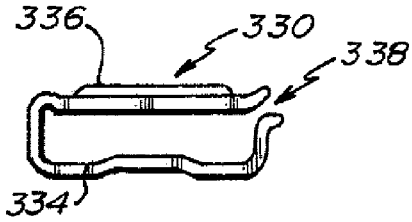
FIG. 12*c* is a close-up elevational view of the friction slider of FIG. 12*a;*

Referring to FIGS. 12*a*, 12*b*, and 12*c*, friction slider 330 generally includes a slider channel 334 sized for placement over and/or around support arm 306, an aperture 336 for set screw 332, and an opening 338 or seam selectively presented therein along a length thereof enabling friction slider 330 to be detached and/or reattached to support arm 306. In embodiments, a latch, snap, or other mechanical or non-mechanical mechanism can be used in lieu of or in addition to opening 338 enabling friction slider 330 to be selectively attached and detached with respect to support arm 306.

Such a feature (e.g., opening 338 or seam, as depicted) and the configuration of friction slider 330 can enable ease of replacement of friction slider 330 for wearing out or otherwise need replacement. Specifically, to remove friction slider 330 from support arm 306, a top portion of friction slider 330 comprising aperture 336 therein can be flexed or otherwise effectively moved away from or relative to a lower portion of friction slider 330, such that channel 334 and opening 338 are opened, thus widening opening 338. Friction slider 330 can then be removed from its position on support arm 306 (FIG. 11). If friction slider 330 has worn or otherwise needs to be cleaned or replaced, friction slider 330 can then be removed from drive link 308.

Yet another embodiment of a friction slider assembly 400 with an offset included on friction slider or sleeve is illustrated in FIGS. 13-16. Friction slider assembly 400 according to this embodiment can provide creep relief for a friction slider or sleeve when hinge is closed, which is the state in which hinge is in for a majority of window's life cycle. By so doing, the life of friction slider assembly 400 can be lengthened.

Figure 13:
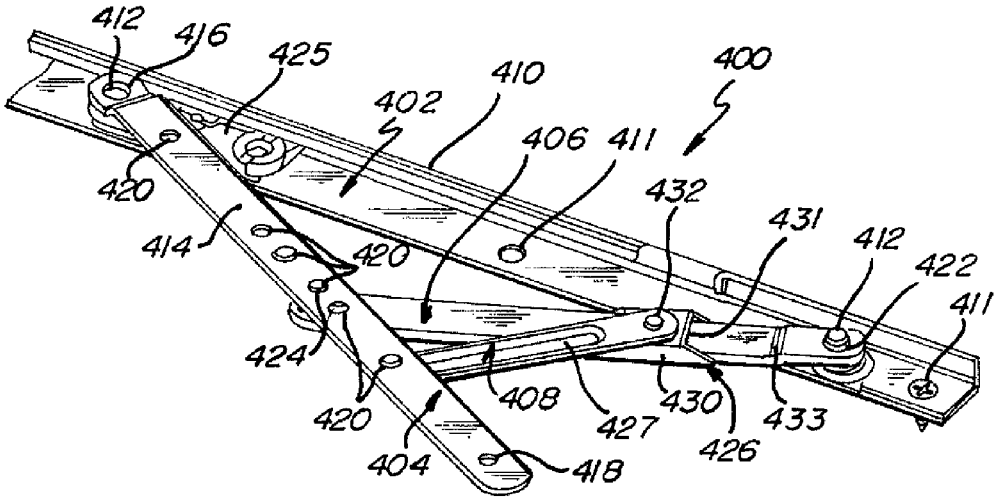
FIG. 13 is a top perspective view of an embodiment of a friction hinge assembly including a friction slider with an offset thereon.
Figure 14:
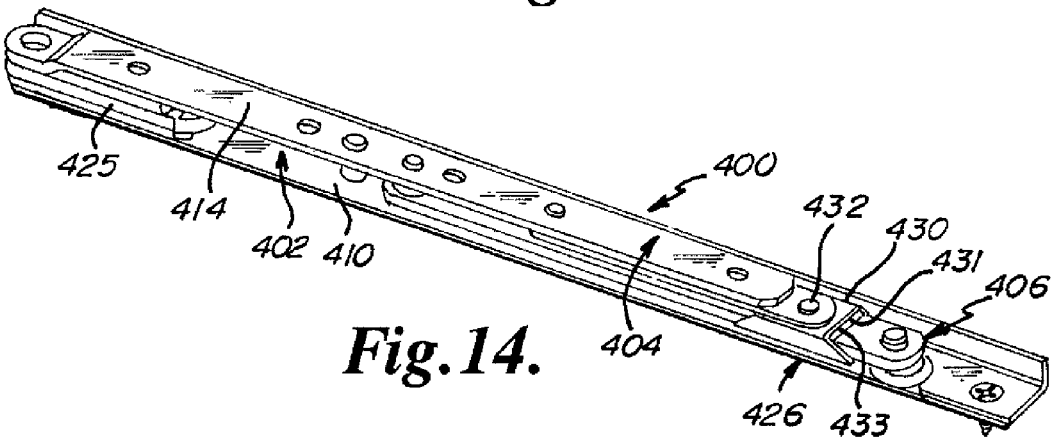
FIG. 14 is a top perspective view of the friction hinge assembly of FIG. 13, wherein the friction hinge assembly is in a closed configuration.
Figure 15:
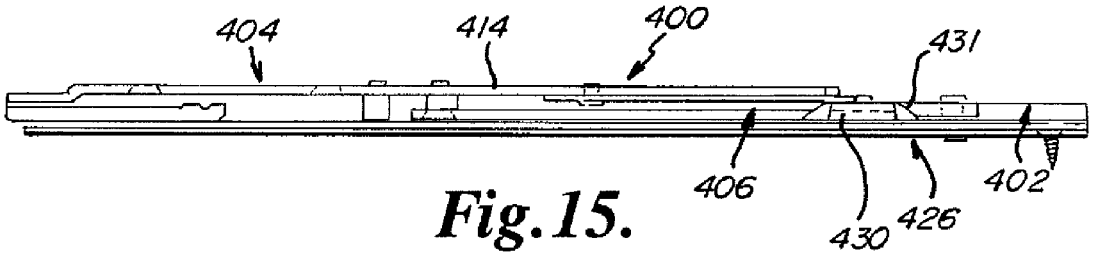
FIG. 15 is a side elevational view of the friction slider of FIG. 15, depicting various portions in phantom lines.

Referring to FIGS. 13 and 14, a friction hinge assembly 400 of this embodiment generally includes a track 402, a sash arm 404, a support arm 406, and a slidable friction arm assembly 408 comprising detachable slider assembly 426 and a friction arm or drive link 427. Track 402 generally comprises a track body 410, a plurality of track mounting apertures 411, and a plurality of track connecting members 412. Track connecting members 412 generally includes apertures for receiving connectors such as, rivets or disassemblable fasteners, and track connecting members 412 can further comprise projecting members (as depicted) integral to track body 410. Sash arm 404 generally comprises a sash arm body 414, a track aperture 416, a sash window aperture 418, and a plurality of adjustment apertures 420. Support arm 406 generally includes a support track aperture 422 and a connecting member 424 for operably coupling support arm 406 with sash arm 404.

Slidable friction arm assembly 408 generally includes a slider assembly 426 and a friction arm 427 having a friction sash aperture. The force required to close an open window can be manipulated through the inclusion of a polymeric washer or spacer 425 at one or both of the support sash aperture 424 and the sash track aperture 416. Also, as discussed above, the mechanics of hinge 400 can be altered or adjusting using adjustment apertures 420.

Figure 16:
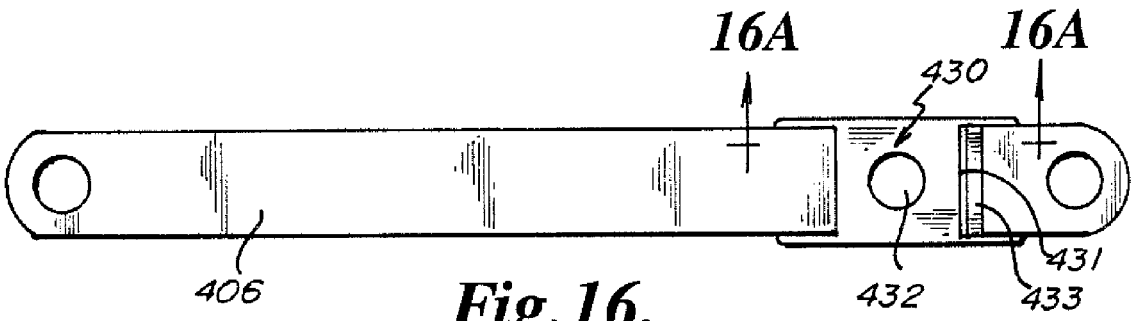
FIG. 16 is a top plan view of a support arm of the friction hinge assembly of FIG. 13, depicting the friction sleeve in a closed position.
Figure 16A:
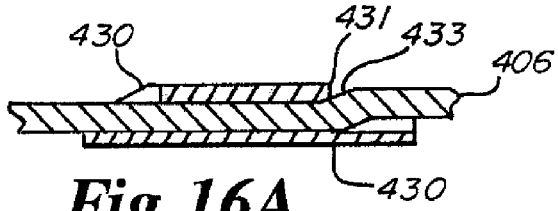
FIG. 16A is a cross-sectional view taken along line A-A of FIG. 16.

Referring to FIGS. 14, 16, and 16A, friction slider 430 comprises an offset 431 generally corresponding to an angled support are offset 433 included on support arm 406 enabling the opening and closing of the hinge 400. Slider offset 431 can provide creep relief to friction slider 430 when the hinge is closed (see FIGS. 14 and 15), which can be the majority of the window's life cycle. Specifically, when hinge 400 is in its closed position, slider offset 431 and support arm offset 433 are configured such that slider offset 431 is not placed in a stressed state by support arm offset 433.

The embodiments above are intended to be illustrative and not limiting. Additional embodiments are encompassed within the scope of the claims. Although the present invention has been described with reference to particular embodiments, those skilled in the art will recognize that changes may be made in form and detail without departing from the spirit and scope of the invention. For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A window assembly comprising:

a frame defining an opening;

a sash assembly receivable in the opening of the frame;

at least one friction hinge operably coupling the sash assembly to the frame such that the sash assembly is selectively shiftable between a closed position in which the sash assembly is received in the frame to close the opening and an open position in which the sash assembly is disposed at an angle relative to the frame, the friction hinge comprising:

a track on the frame;

a spacer slidable along the track;

a sash arm on the sash, the sash arm pivotally coupled to the spacer;

a support arm pivotally coupled to the track and directly pivotally coupled to the sash arm at a first pivot; and a friction arm assembly including a one-piece friction arm pivotally coupled to the sash arm at a second pivot spaced apart from the first pivot, and a friction slider assembly pivotally coupled to the friction arm and slidable along the support arm, wherein the friction slider assembly frictionally engages the support arm to provide a biasing force resisting shifting of the sash assembly between the open position and the closed position.

2. The window assembly of claim 1, wherein the friction slider assembly includes a slider frictionally engaged with the support arm and a friction adjustment mechanism for enabling selective adjustment of a magnitude of friction between the slider and the support arm.

3. The window assembly of claim 2, wherein the friction adjustment mechanism comprises a set screw.

4. The window assembly of claim 2, wherein the friction adjustment mechanism comprises an adjustable cam.

5. The window assembly of claim 2, wherein the slider is coated with a polymeric material.

6. The window assembly of claim 5, wherein the polymeric material is acetal.

7. The window assembly of claim 1, wherein the friction slider assembly is selectively detachable from the friction arm and the support arm.

8. The window assembly of claim 1, wherein the support arm has an offset portion disposed so that the friction slider assembly is engaged with the offset portion when the sash assembly is in the closed position.

9. A friction hinge for an operable window assembly, comprising:

a track;

a spacer slidable along the track;

a sash arm, the sash arm pivotally coupled to the spacer;

a support arm pivotally coupled to the track and directly pivotally coupled to the sash arm at a first pivot; and a friction arm assembly including a one-piece friction arm pivotally coupled to the sash arm at a second pivot spaced apart from the first pivot, and a friction slider assembly pivotally coupled to the friction arm and slidable along the support arm, wherein the friction slider assembly frictionally engages the support arm to provide a biasing force resisting sliding of the friction slider assembly on the support arm.

10. The friction hinge of claim 9, wherein the friction slider assembly includes a slider frictionally engaged with the support arm and a friction adjustment mechanism for enabling selective adjustment of a magnitude of friction between the slider and the support arm.

11. The friction hinge of claim 10, wherein the friction adjustment mechanism comprises a set screw.

12. The friction hinge of claim 10, wherein the friction adjustment mechanism comprises an adjustable cam.

13. The friction hinge of claim 9, wherein the friction slider assembly is selectively detachable from the friction arm and the support arm.

14. The friction hinge of claim 9, wherein the support arm has an offset portion.

* * * * *

UNITED STATES PATENT AND TRADEMARK OFFICE

CERTIFICATE OF CORRECTION

PATENT NO. : 7,900,322 B2
APPLICATION NO. : 11/961861
DATED : March 8, 2011
INVENTOR(S) : Craig M. Doring et al.

It is certified that error appears in the above-identified patent and that said Letters Patent is hereby corrected as shown below:

Column 1, line 8, please delete “60/988,871” and insert --60/986,871--;
Column 6, line 20, please delete “fiction” and insert --friction--;
Column 6, line 42, please delete “to as to” and insert --so as to--;
Column 7, line 2, please delete “to as to” and insert --so as to--;
Column 7, line 53, please delete “adjusting” and insert --adjusted--;
Column 7, line 67, please delete “for” and insert --if--;
Column 8, line 1, please delete “needed” and insert --needing--;
Column 8, line 44, please delete “adjusting” and insert --adjusted--.

Signed and Sealed this
Twenty-seventh Day of March, 2012

David J. Kappos

David J. Kappos
*Director of the United States Patent and Trademark Office*